United States Patent [19]

Höffken et al.

[11] 4,268,543

[45] May 19, 1981

[54] PROCESS AND DEVICE FOR PRODUCING THE REFRACTORY LINING OF METALLURGICAL VESSELS

[75] Inventors: Erich Höffken, Dinslaken; Karl-Dieter Beckers, Neunkirchen-Seelscheid, both of Fed. Rep. of Germany

[73] Assignee: Martin & Pagenstecher GmbH, Köln-Mülheim, Fed. Rep. of Germany

[21] Appl. No.: 943,840

[22] Filed: Sep. 19, 1978

[30] Foreign Application Priority Data

Sep. 21, 1977 [DE] Fed. Rep. of Germany ..... 2742415

[51] Int. Cl.[3] ..... B05D 7/22

[52] U.S. Cl. ..... 427/230; 264/30; 427/140; 427/240

[58] Field of Search ..... 427/240, 230, 140; 264/30

[56] References Cited

U.S. PATENT DOCUMENTS

| | | | |
|---|---|---|---|
| 3,653,951 | 4/1972 | Maldeis et al. | 427/240 |
| 3,737,489 | 6/1973 | Murton | 264/30 |
| 3,872,912 | 3/1975 | Axmann | 264/30 |
| 3,897,256 | 7/1975 | Murton | 106/84 |
| 4,108,384 | 8/1978 | Egli | 264/30 |

*Primary Examiner*—Ronald H. Smith
*Assistant Examiner*—Janyce A. Bell
*Attorney, Agent, or Firm*—Sprung, Felfe, Horn, Lynch & Kramer

[57] ABSTRACT

An improvement in a process for forming a refractory lining on the interior walls of the metallurgical vessel which interior walls are coaxial to the principal axis of the vessel wherein a refractory mass containing a binder is centrifugally slung onto the interior walls in a direction normal thereto while the vessel is at a standstill is disclosed. According to the invention, the refractory mass is initially shaped into balls prior to being centrifugally slung and the balls are centrifugally slung in rapid succession to form a mass jet. Also disclosed, is a device for so slinging a refractory mass on the walls of a vessel comprising a slinger head having a slinger wheel and a motor and at least one supply conduit for supplying refractory mass to be slung. The slinger wheel of the slinger head is disposed on one end of a shaft which shaft is extendable into a vessel, the slinger wheel being connected to an actuatable by a slinger motor. The slinger unit includes a slinger head, the shaft and the slinger motor as well as the supply conduit and is rotatable about the axis which extends in the direction of the entrance to the vessel.

10 Claims, 5 Drawing Figures

PROCESS AND DEVICE FOR PRODUCING THE REFRACTORY LINING OF METALLURGICAL VESSELS

BACKGROUND OF THE INVENTION

1. Field of the Invention

This invention relates to a process and apparatus for applying a refractory mass to inner walls of a vessel, especially a metallurgical vessel. More especially, this invention relates to a process and apparatus for forming a refractory lining on the interior walls of a metallurgical vessel, especially a metallurgical vessel containing the brickwork of the wall being worn by slinging a refractory mass centrifugally to the walls of the vessel in a direction normal thereto. This invention is particularly concerned with the formation of a circulating mass jet normal to the direction of the walls of the vessel and to formation of a refractory living having good density characteristics thereon. The invention is also concerned with a device for carrying out the process.

2. Discussion of the Prior Art

A process of the above mentioned type is described in the German Offenlegungsschrift No. 2,363,776. For restoring the refractory lining of casting ladles, this Offenlegungsschrift proposes that a refractory mass containing up to 4% dry binding means and 4–6% water be slung onto the vertical ladle wall using the centrifugal force when the smooth (used or worn) brickwork is at a temperature of at least 120° C. A centrifugal slinging machine having two lateral arms at the end of a shaft constructed in the form of a tube conduit, said lateral arms being for the discharge of the refractory mass, serves as slinger here. The shaft is arranged in the casting ladle axis of the perpendicular casting ladle in such a way that it can be raised and lowered. The mass containing binding means is continuously slung through the rotating shaft and the circulating arms towards the ladle using centrifugal force. This forms a continuous jet of mass.

While the prior known method may permit the special refractory mass to be applied to the hot wall of vessels of lesser diameter, problems arise with vessels of larger diameter and even with vessels of lesser diameter, when the temperature of the vessel is higher, e.g., 300° C. and higher; then the mass can achieve a cohesive state in the supply conduit; this leads to blockages.

When using said prior art with vessels of larger diameter more serious problems arise as with ladles of greater diameter, e.g., with a capacity of 100 tons or 200 tons. The continuous jet of the mass is splintered or spread fanwise on the long passage from the slinger to impact against the vessel wall. This causes the coarser constituents of the mass to become separated from the fine constituents due to the air resistance. There is then the danger that a high proportion of the refractory mass does not adhere on the vessel wall or, in the case where a sufficient proportion adheres, the mass is not applied to the remaining brickwork in the desired density.

In another process which has proved itself in the relining of casting ladles a slinger machine slings the refractory mass in the shape of lumps substantially vertically over a short distance into the space between the casting ladle wall and a mold (see German Auslegeschrift No. 1,483,584). In this prior art, the lump sequence amounts to about 25 lumps per second, the lumps being slung out of the slinger at a speed of more than 40 m/sec. and being packed within said space one on another.

A device has also become known for a slinging technique (German Offenlegungsschrift No. 2,035,039) which mixes the refractory mass and the binder in the slinger head immediately before slinging the mixture. In this device the slinger head is attached to the front end of an arm articulated successively in different planes and is supplied with refractory slinger mass through tubes by means of an air stream. Water is sprayed by means of spray nozzles onto the refractory mass supplied in the slinger head. The slinger head is inserted into the vessel and swivelled to all sides to line the metallurgical vessel. With this device there is the danger of the refractory mass segregating in the supply tubes due to the refractory mass being pneumatically supplied. There is also the danger of the supply tubes being damaged due to the elevated temperatures which are present when vessels are lined which are still in hot state. Besides this a pneumatical supply of the refractory mass is impossible when the mass contains a slight amount of moisture or fluid binder.

It is an object of this invention to provide a process which guarantees the formation of a high density liner on the inner walls of a vessel by employing centrifugal force to dispose a refractory mass on the inner walls of a vessel, whilst the axis of the vessel is vertical and without substantial rebound of the applied refractory mass from the vessel wall. Moreover, it is a particular object of this invention to provide a process which can be peformed in vessels of large diameter such as for example, casting ladles with a capacity of over 100 tons, particularly when the vessel wall is still hot. A further object of the invention is to provide a device for carrying out the process.

SUMMARY OF THE INVENTION

In accordance with this invention, there is provided an improvement in a process performing a refractory lining on the interior wall of a vessel which interior wall is coaxial to the vertical axis of the vessel wherein a refractory mass containing a binder is centrifugally slung onto said interior wall in a direction normal thereto while said vessel is at the standstill, the improvement residing in forming the refractory mass initially into lumps and then slinging said mass to said wall in form of a rotating jet consisting of rapidly succeeding lumps.

Preferably, the process of the invention is conducted by initially forming lumps of the refractory mass and a binder and then slinging those lumps in quick succession to form a mass jet. It has proven advantageous to apply the lumps to the wall at a lump sequence of at least 40 lumps per second, preferably 50 or more lumps per second. The weight of each lump may amount to at least 150 grams, preferably 150–450 grams and in particular 280–360 grams.

In carrying out the process, it is important to coordinate the lump sequence and the circulation of the mass jet in such a way that the lumps are applied to the vessel wall so that at said wall their surfaces overlap each other by an area of at least 30%, preferably at least 50%. This overlapping guarantees constant thickness of the lining and a compaction of previously applied lumps by succeeding lumps. The slinging of the lumps can be carried out in successive annular sections although it is preferred that the mass jet be directed to the walls of the vessels helically as such application produces a liner of particularly uniform thickness and density.

The process according to the invention is especially suited to the restoration of refractory linings of metallurgical vessels whose capacity is greater than 100 tons, particularly if used or worn brickwork of the interior of such metallurgical vessels is to be restored while the same remain hot, e.g., have a temperature of more than 300° C. in particular more than 500° C.

The refractory mass to be used preferably does not have a particle fraction in excess of 3 mm, as this promotes the compaction of the lumps even over larger slinging areas.

It should be noted that by the process of the invention a highly densified and smooth lining of uniform thickness can be produced even at vessels of great diameters without the use of a template and by slinging the refractory mass horizontally over larger distances owing to the great rate at which the lumps are hit against the wall of the vessel and the degree of lump overlap on the vessel.

For carrying out the process, a device may be provided which differs from known slinger units in that the slinger wheel of the slinger head is positioned on the lower end, e.g., terminal end of a shaft which extends in the axis of the vessel into which the slinger is inserted, which slinger wheel is rotated by a slinger motor. The slinger unit comprising the slinger head, shaft, slinger motor and at least one supply conduit for supplying refractory mass is rotatable by a second motor, called rotary motor, about its axis which extends in the direction of the vessel. The slinger unit is preferably connected to the lower end of a housing containing said rotary motor. In contrast to the known slingers, the shaft rotated by the slinger motor extends in the direction of the feeding of the slinger unit into the vessel, e.g., in the case of a ladle or converter in the axis of these vessels.

The slinger head and the slinger wheel extend in a plane normal to said axis, i.e., in a horizontal plane if used for producing a lining in vessels having a vertical axis; in such cases the lumps are ejected. In order to cover an annular section on the vessel wall when the lumps are being ejected horizontally, the slinger unit may be moved vertically against the housing of the rotary motor. As the rotation speed of the slinger unit can be infinitely regulated by the rotary motor, an uniform application of the mass in desired thickness onto the wall of the metallurgical vessel is possible. According to a preferred embodiment, the parts of the machine housing and the slinger unit which are sensitive to heat are enveloped by cooled jackets, preferably cooled by means of air or water, so that the slinger unit can be used to restore or reline vessels while they are still hot.

In addition to the supply pipes for the refractory mass to be slung, pipes for the supply of the liquid binder may be provided. This facilitates the transport of the refractory mass, as the refractory mass only needs to be mixed to a cohesive state when it is in the slinger unit. Thus, the liquid binder conveyed through the supply pipes can be sprayed onto the refractory mass by means of nozzles after it has arrived in the slinger head. A construction is preferred in which the supply pipes for the refractory mass and the supply pipes for the liquid binder are fed into a mixing area formed by a jacket enveloping the shaft at a distance therefrom.

In a preferred construction a mixing screw is arranged on the shaft in the mixing area and the supply pipes for the refractory mass and those for the liquid binder are fed into the mixing area in front of the mixing screw, i.e., between the mixing screw and the slinger motor. With this construction segregation of the components of the refractory mass is avoided and pre-conditions for uniform application of the refractory mass onto the vessel wall is favoured.

A particular advantage of the claimed construction is to be found in the feature that the entire slinger unit represents a closed construction. Due to the closed construction, underpressure is produced in the slinger unit which is so great that the refractory mass is sucked in out of the inside of the slinger head house and the supply pipes connected thereto. This reduces the danger of blockage. In addition, only very small amounts of air are ejected by the slinger, thus considerably reducing the danger of the segregation of fine particles and the coarser constituents in the ejected lumps. A special mass regulator is provided to regulate the inlet of the amount of refractory mass.

In some metallurgical converters the converter vessel wall extends in the form of a truncated cone in its upper and lower portion. The upper truncated-cone-shaped portion is also known as a converter hood. In order to guarantee an uniform application of the refractory mass in these parts, the slinger unit may be swivable about an axis which lies transversely to the axis about which the slinger unit is rotated. A solution which is particularly simple from a constructive point of view results when the slinger unit is suspended on an axis crossing the lower convergent ends of the pipes for the mass. When the slinger unit is introduced in the interior of the vessel in such a way that the axis about which it is rotated by the rotary motor coincides with the axis of the vessel, inclined walls of the vessel may be covered by the lump of refractory mass coordinating the angle of inclination of the swivelling unit to the inclination of the converter wall so that the lumps always strike the converter wall normally. Adjustment may be achieved by hand after some screws have been loosened, but is preferably carried out automatically by means of an additional servomotor.

To guarantee the very quick lump sequence, the slinger head has for expedience two scoops which are arranged at a circumferential distance of 180°. The rotational speed of the shaft is selected in such a way that the lumps are ejected from the slinger unit at over 40 m/sec., preferably about 50–60 m/sec. The speed at which the slinger unit is rotated by the rotary motor lies preferably between 2 and 15 revolutions per minute. For raising and lowering, the slinger unit may be coupled to a tube which can be raised and lowered and through which the supply means run. Restoring a converter is particularly facilitated when a blow lance is used after slight adaption as a raising and lowering tube. It is merely necessary to cut an oblong hole into the lance construction and to guide the supply means therethrough.

The binding means can be mixed with the refractory mass as a dry binder prior to entering the slinger. Water in amounts of 4–7% may be added in the slinger unit to this mass containing dry binder. However, tar or water glass can also be used as binder; in order to facilitate the supply of such binders it may be expedient to heat the binder before transporting. The transport of the refractory mass is achieved easily by gravity and may be supported by a suction effect due to a closed construction of the slinger head.

The particular advantages of the subject matter of the invention can be summarized as follows:

The process enables a restoration of the refractory lining of vessels particularly of large-capacity metallurgical vessels, while the remaining brickwork of the vessel is still hot so that the vessels are available again in a short time. A dense consistency of the applied mass is achieved even with large-capacity converters, as compact lumps strike the vessel wall with high kinetic energy. A greatly uniform surface is achieved with the process without using a mold or a template. The device according to the invention is distinguished by its compactness. The supply of the refractory material is achieved simply by gravitational force and by the suction effect of the slinger head without an application of means to be moved, the mixing to a cohesive state is undertaken just shortly before the formation of the lumps so that segregation does not occur during transport.

The slinger can be slightly adapted to be attached to an oxygen blow lance which is particularly inexpensive. The desired quick lump sequence may be guaranteed by arranging two scoops provided so that the rotational speed of the slinger motor does not have to be unnecessarily high.

BRIEF DESCRIPTION OF DRAWINGS

In order to more really understand the invention and the manner in which the same is practiced, the following drawings are presented.

In the drawings.

DESCRIPTION OF SPECIFIC EMBODIMENTS

Figure 1:
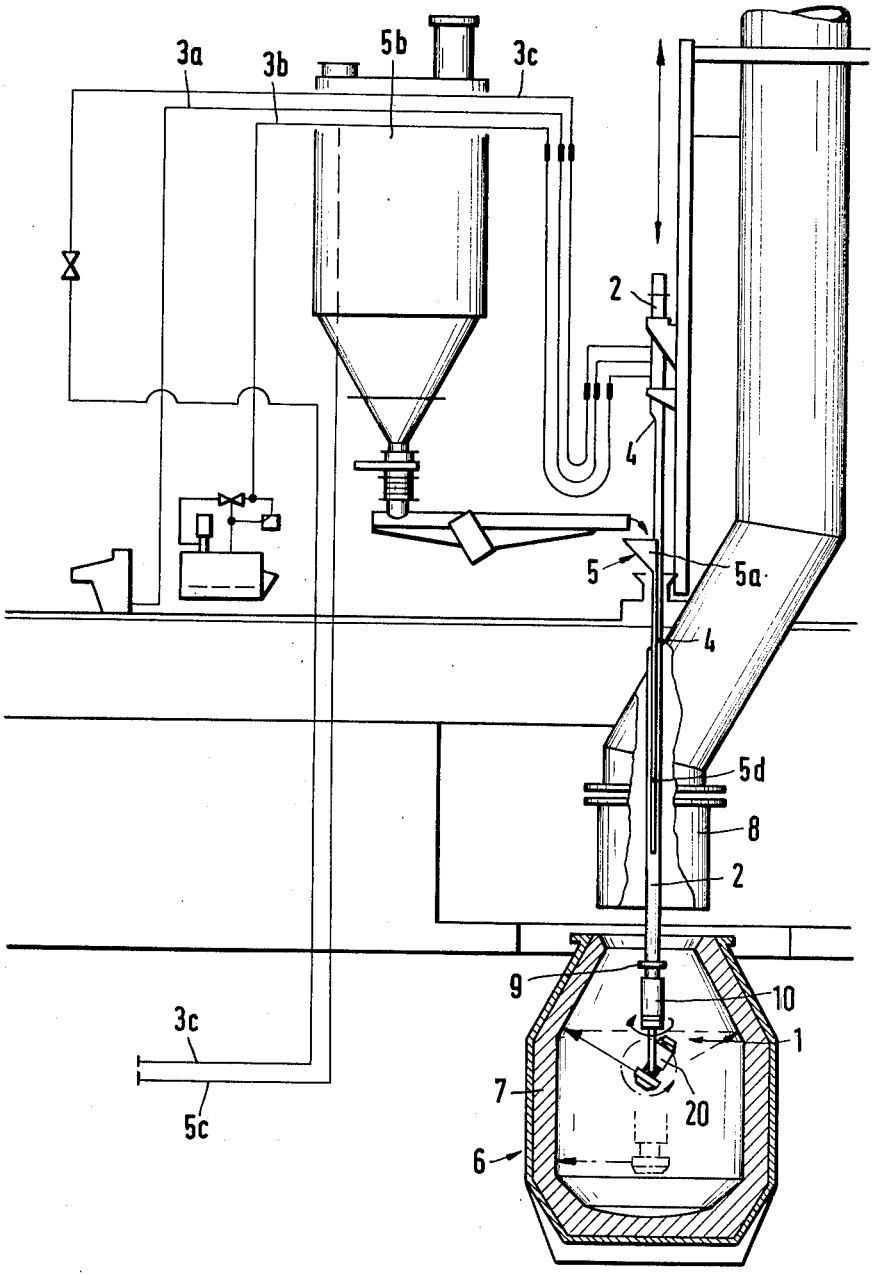
FIG. 1 is a side elevational view partly broken away showing the disposition of a slinger during the lining of a metallurgical converter.

The slinger, generally represented by reference numeral 1, is composed substantially of the slinger unit 20 and the machine housing 10. The slinger 1 is coupled by means of a coupling 9 to a vertically extending lance 2 (i.e., a hollow shaft) which can be raised and lowered. A charging means (generally represented by reference numeral 5) comprising a funnel-shaped mouth 5*a* and a vertical tube 5*d* connected thereto is arranged in the lance 2 for the supply of the refractory mass containing dry binder. A supply line 3*a* for electric current, a supply pipe 3*b* for a liquid for activating the binder (e.g. water), and a supply pipe 3*c* for the supply of cooling air pass through the lance 2. In the wall of the lance 2 an oblong vertical hole 4 is provided at which the mouth 5*a* is fixed in such a way that it remains in its position when moving the lance 2 in the vertical direction. The funnel mouth 5*a* is supplied with said refractory mass from a mass container 5*b*. The mass container 5*b* can be filled by a tube 5*c*.

The dotted lines show the slinger 1 in a low position with the slinger unit 20 in the cylindrical center portion of a converter 6. When in the upper position the slinger is positioned in the conical hood portion of the converter 6. The slinger slings the mass onto the worn brickwork 7 of the converter 6. A dust extractor 8, which is switched on during slinging to suck off the dust particles, is positioned above the converter hood.

Figure 2:
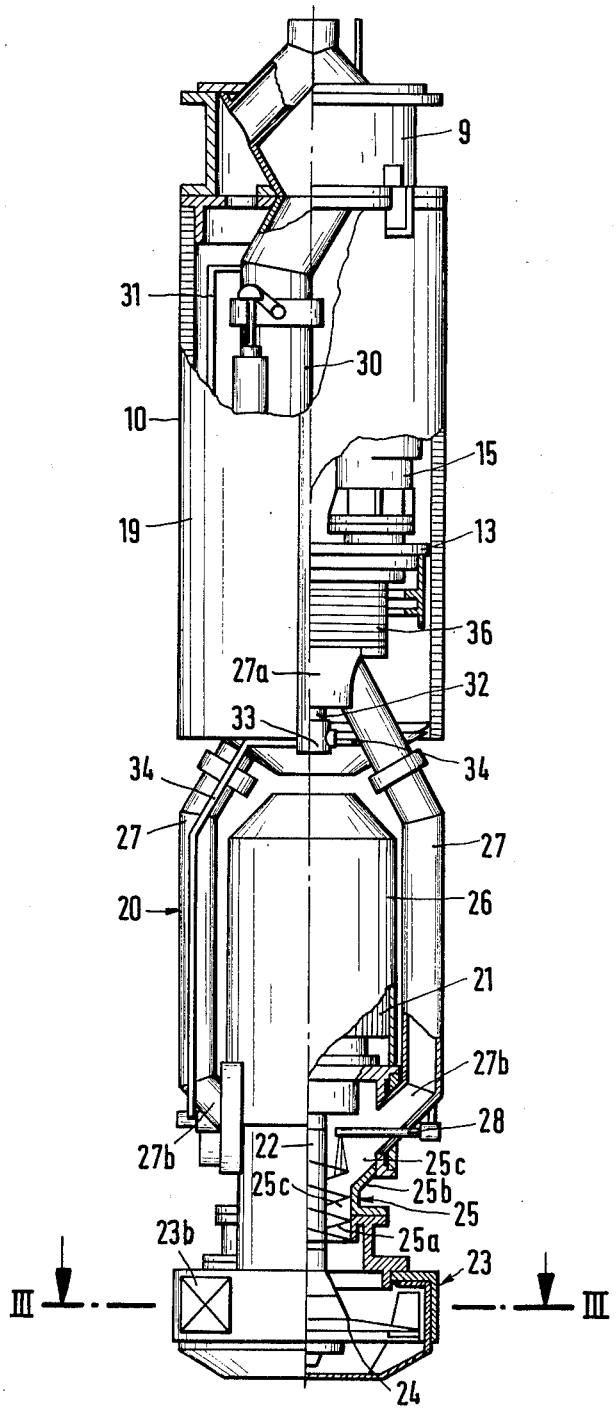
FIG. 2 is a side elevational view on an enlarged scale of a portion of the slinger of FIG. 1, the view being partially broken away and partially in longitudinal cross-section.
Figure 3:
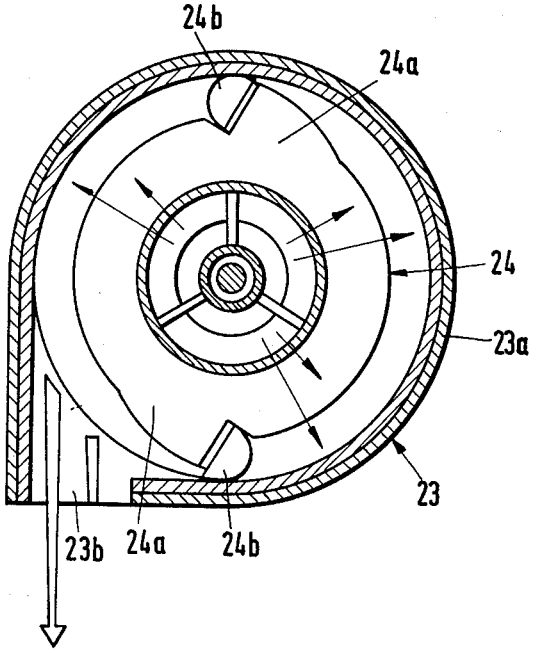
FIG. 3 is a cross-section view taken along the lines III—III of FIG. 2.

FIG. 2 shows in its lower part the slinger unit generally represented by reference numeral 20 with the slinger head 23 and the shaft 22 which is driven by the slinger motor 21. The slinger head 23 comprises a horizontal housing 23*a* (FIG. 3), an ejector opening 23*b* and a slinger wheel 24. The slinger wheel 24 comprises a slinger dish 24*a* on its lower end and two scoops 24*b* diametrically arranged.

Figure 5:
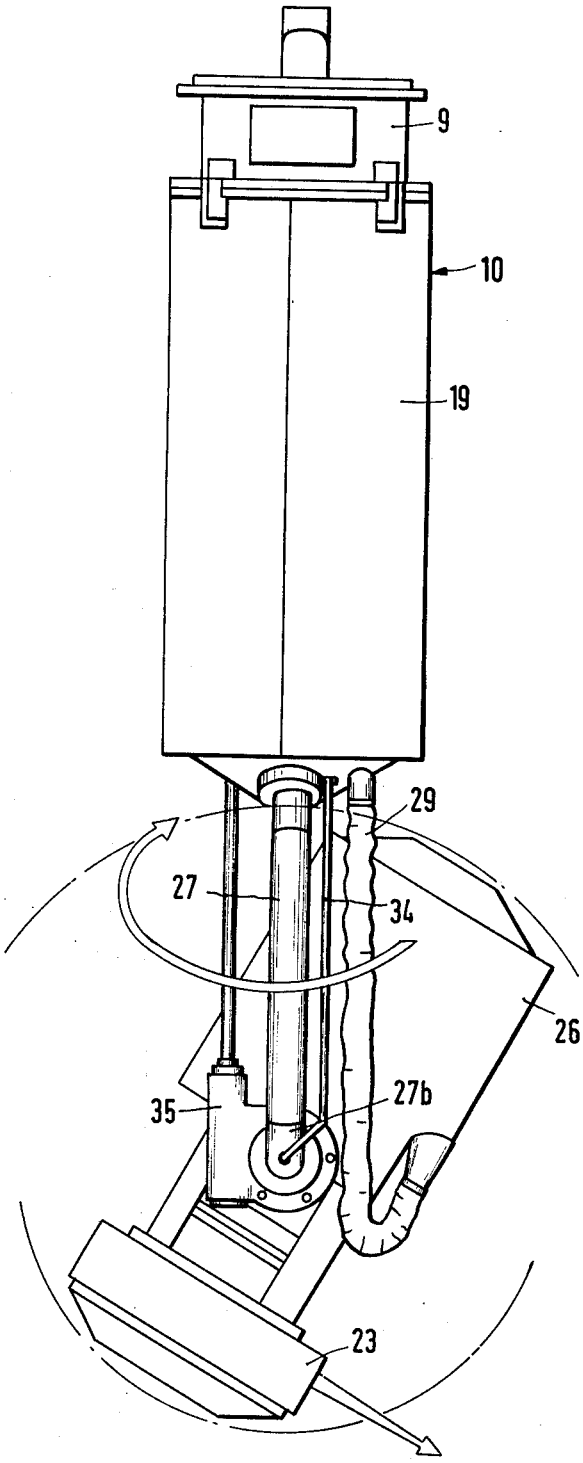
FIG. 5 shows the subject of FIG. 2 viewed from the side after the slinger motor, shaft and slinger head have been swivelled.

A mixing device 25 is arranged above the slinger dish 24*a*. It comprises a mixing screw 25*a* driven by a shaft 22 and being enveloped by a funnel-shaped jacket 25*b*. Two pipes 27 for the supply of the refractory mass feed into the mixing area 25*c* within this jacket 25*b* above the mixing screw 25. The supply pipes 27 have a common upper end 27*a* which is disposed in the machine housing 10. Nozzles 28 connected to supply pipes 34 feed a binding means or water for activating a dry binding means contained in the refractory mass into the mixing area 25*c*. The slinger motor 21 is enveloped by an air-cooled jacket 26 which is supplied with cooling air by means of flexible metal tubes 29 (FIG. 5). The slinger unit 20 comprising the slinger motor 21, shaft 22, slinger head 23, mixer 25, pipes 27 and 34 can be rotated around its own longitudinal axis.

Figure 4:
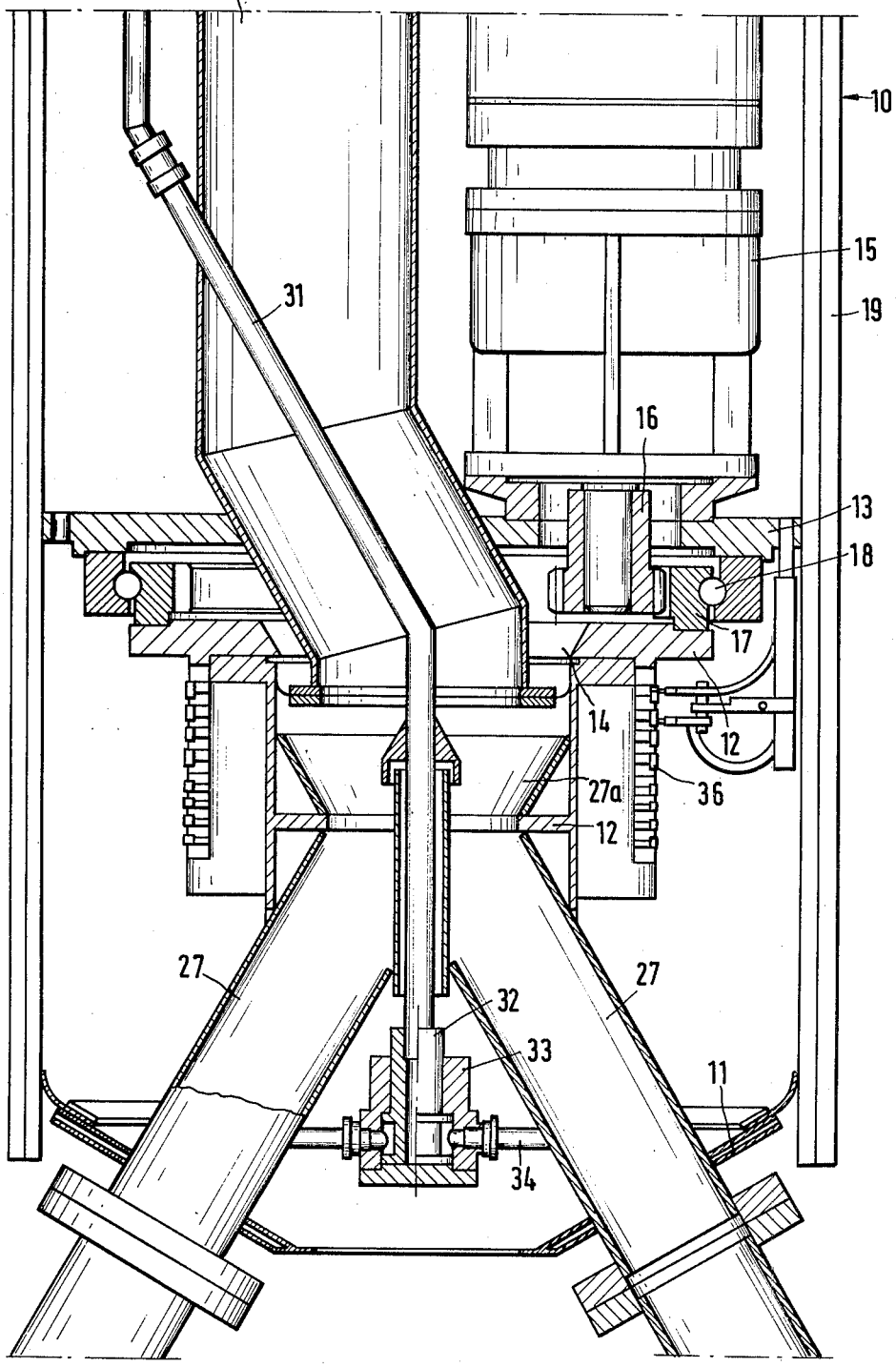
FIG. 4 shows a detail of FIG. 2 on a still further enlarged scale.

As FIG. 4 shows, the common upper end 27*a* of the supply pipes 27 continues upwards in a fixed supply pipe 30. The machine housing 10 is enveloped by an air-cooled jacket 19 and its lower end is substantially closed by a cover plate 11 which is connected to the slinger unit 20. The rotatable upper end 27*a* of the supply pipes is held by a frame 12 which is pivoted in a carrier plate 13 fixed to the machine housing 10. The frame 12 has an axial passage 14 to permit the supply pipes 30 to pass therethrough. The rotary motor 15 rotates the frame 12, the cover plate 11 and the slinger unit 20 therewith by means of a planet wheel 16, a sun wheel 17 held by a ball bearing 18. A fixed supply pipe 31 for supplying liquid for binding purposes is passed through the fixed supply pipe 30 to the center part of the machine housing 10 and from there centrally through the upper end 27*a* of the supply pipes 27. The fixed supply pipe 31 feeds into a plug connection 32 of a coiler 33. The supply pipes 34 lead from there to the supply nozzles 28.

As FIGS. 1 and 2 show, the fixed supply pipes 30, 31 are connected to the upper end of the lance 2 by means of the coupling 9.

FIG. 5 illustrates a construction which enables a swivelling capacity of the slinger head 23. This swivelling is of advantage when lining conical parts, e.g., for lining a converter hood. The swivelling axis passes through the lower ends 27 of the two supply pipes 27 which are inclined to each other and form a fork-shaped structure. The slinger unit 20 comprising the slinger motor 21, the shaft 22 and the slinger head 23 is adapted to swivel about its axis. In FIG. 5 the slinger motor and the shaft are covered by an air-cooled jacket 26. A servomotor 35 is provided for automatic adjustment. The air-cooled jacket 19 of the machine housing 10 is connected to the air-cooled jacket 26 by means of flexible metal tubes 29.

The working method of the device according to the invention is as follows:

The slinger 1 is coupled to the lance 2 and moved into the vertically positioned converter when the brickwork to be lined is still hot. The slinger unit 20 rotates, for example, at 10 revolutions per minute and the slinger wheel 24 at 1500 revolutions per minute so that 300 lumps per minute are ejected by the two scoops 24*b*. Due to the closed construction and the slinger extending vertically downwards, the refractory mass containing dry binder is sucked downwardly through the pipes 27, sprayed with water in the mixing area 25*c* and subsequently mixed by the mixing screw 25*a*. The mixture falls then on the slinger dish 24*a*, is slung radially outwards on it, caught by the scoops 24*b* and slung out of the ejector opening 23*b* in form of individual lumps. As the slinger unit 20 rotates around its own axis, the individual lumps form a mass jet hit against the vessel wall so that the lumps hitting said wall overlap each other at about half a width of a lump. Due to the overlapping, the succeeding lump always make the previous ball denser. When the annular section has been completed, the slinger is raised by half the height of the ring and the next annular section is slung. As it is only raised by half the height of the ring, the lumps hitting the vessel wall also overlap vertically. It has been shown that a substantially even and very dense refractory lining can be produced in this way. The mass jet is preferably applied to the converter wall spirally by combining the rotary action of the slinger unit 20 with the raising and/or lowering movement of the lance 2.

When a conical converter hood (FIG. 5) has to be slung, the slinger head is swivelled with the aid of the servomotor 35 between the fork-shaped supply pipes 27 so far that the swivelling plane runs normal to the wall of the converter hood. The supply of the refractory mass and the rotational speed of the slinger motor 21 are coordinated in such a way that lumps of 320 g in weight are formed in the slinger head and are then slung out of the slinger head.

What is claimed is:

1. A process for forming a refractory liner on the interior wall of a vessel which interior wall is co-axial to the principal axis of the vessel which comprises initially shaping a refractory mass into lumps, thereafter slinging said lumps centrifugally onto said interior wall in a direction normal thereto while said vessel is at a standstill, the refractory mass being slung in rapid succession to form a mass jet.

2. A process according to claim 1 wherein said lumps are slung at a velocity of at least 40 lumps per second.

3. A process according to claim 2 wherein the lumps are applied to the vessel wall so that succeeding lumps overlap each other on at least 30 percent of the area occupied by lump on said wall.

4. A process according to claim 2 wherein the weight of each lump is at least 150 grams.

5. A process according to claim 4 wherein the weight of each lump is between 150–450 grams.

6. A process according to claim 5 wherein the weight of each lump is between 280–360 grams.

7. A process according to claim 1 wherein the slinging plane is substantially normal to the plane of the wall to which the lumps are slung.

8. A process according to claim 1 wherein the lumps are supplied helically to the vessel wall.

9. A process according to claim 1 wherein said mass jet is slung onto a hot vessel wall.

10. A process according to claim 1 wherein the source of said refractory mass which is slung centrifugally against the walls in a direction normal to the walls is moved along the path of the wall so as to coat successive portions of said interior wall.

* * * * *